US011385031B1

(12) United States Patent
Britcher et al.

(10) Patent No.: US 11,385,031 B1
(45) Date of Patent: Jul. 12, 2022

(54) NON-LETHAL DISORIENTATION APPARATUS

(71) Applicants: Gary Britcher, Aspinwall, PA (US); Dom Costa, Pittsburgh, PA (US)

(72) Inventors: Gary Britcher, Aspinwall, PA (US); Dom Costa, Pittsburgh, PA (US)

( * ) Notice: Subject to any disclaimer, the term of this patent is extended or adjusted under 35 U.S.C. 154(b) by 0 days.

(21) Appl. No.: 17/502,092

(22) Filed: Oct. 15, 2021

Related U.S. Application Data

(63) Continuation of application No. 17/316,778, filed on May 11, 2021, now Pat. No. 11,162,764.

(60) Provisional application No. 63/024,465, filed on May 13, 2020.

(51) Int. Cl.
*F41H 13/00* (2006.01)
*F21V 23/04* (2006.01)
*F41B 15/02* (2006.01)

(52) U.S. Cl.
CPC ..... *F41H 13/0087* (2013.01); *F21V 23/0407* (2013.01); *F21V 23/0414* (2013.01); *F41B 15/022* (2013.01)

(58) Field of Classification Search
CPC .... F41B 15/02; F41H 13/005; F41H 13/0056; F41H 13/0087
See application file for complete search history.

(56) References Cited

U.S. PATENT DOCUMENTS 1,130,355 A 3/1915 Eschen et al.
3,737,649 A * 6/1973 Nelson ..... F21V 33/0064 362/102
4,486,807 A 12/1984 Yanez
4,842,277 A 6/1989 LaCroix
5,072,342 A 12/1991 Minovitch
5,647,591 A * 7/1997 Parsons ..... F21L 4/00 362/102
6,367,943 B1 4/2002 Tocci et al.
6,526,863 B2 3/2003 Torres
7,180,426 B2 2/2007 Rubtsov
7,239,655 B2 * 7/2007 Casazza ..... F41H 13/0056 359/15
7,524,076 B2 * 4/2009 Kukuk ..... F41H 13/0018 362/112
7,827,726 B2 11/2010 Stokes
8,474,411 B2 7/2013 Scott
8,567,980 B2 * 10/2013 Eisenberg ..... F41H 13/0087 362/109

(Continued)

FOREIGN PATENT DOCUMENTS

CA 3102159 A1 12/2019
CN 108398051 A 8/2018

(Continued)

*Primary Examiner* — Alexander K Garlen

(57) ABSTRACT

An elongated tubular body having a first tubular extension at one end and a second tubular extension at the opposite end. The first tubular extension has a high-intensity light source mounted therein and an opening with the light source being mounted to project a narrow, high intensity light beam through the opening. A cap has light transmitting material covering the opening. The elongated tubular body includes a power supply mounted therein, a switch mounted thereon, and circuitry connecting the switch to the power supply and the power supply to the light source. The switch can be actuated to activate the power supply to supply power to the light source.

20 Claims, 7 Drawing Sheets

(56) References Cited

U.S. PATENT DOCUMENTS

| | | | | |
|---|---|---|---|---|
| 9,886,831 | B1 | 2/2018 | Svoboda et al. | |
| 10,184,650 | B1 * | 1/2019 | Tanzini | F21V 33/0076 |
| 2002/0162852 | A1 * | 11/2002 | Cellini | F41H 9/10 222/1 |
| 2005/0083679 | A1 * | 4/2005 | Macierowski | F41B 15/027 362/102 |
| 2005/0279205 | A1 | 12/2005 | Rode | |
| 2007/0167241 | A1 | 7/2007 | Stethem et al. | |
| 2007/0238532 | A1 | 10/2007 | Stethem | |
| 2008/0236377 | A1 | 10/2008 | Wall | |
| 2009/0284957 | A1 | 11/2009 | Shemwell et al. | |
| 2010/0276514 | A1 | 11/2010 | Stethem | |
| 2011/0072956 | A1 | 3/2011 | Wall | |
| 2012/0140456 | A1 * | 6/2012 | Battis | F41H 13/0056 362/183 |
| 2013/0176711 | A1 * | 7/2013 | Bushee | A45B 3/04 362/102 |
| 2013/0250563 | A1 * | 9/2013 | Kuo | F41B 15/02 362/184 |

FOREIGN PATENT DOCUMENTS

| | | | |
|---|---|---|---|
| JP | 2014006022 | A | 1/2014 |
| WO | 2006078291 | A1 | 7/2006 |

* cited by examiner

NON-LETHAL DISORIENTATION APPARATUS

CROSS REFERENCE TO RELATED APPLICATION

This application is a continuation application of co-pending U.S. patent application Ser. No. 17/316,778 entitled "NON-LETHAL DISORIENTATION APPARATUS" filed May 11, 2021, which claims the benefit under 35 U.S.C. § 119(e) of U.S. Provisional Application No. 63/024,465 entitled "NON-LETHAL DISORIENTATION APPARATUS" filed May 13, 2020, which is incorporated herein by reference.

BACKGROUND

The use of portable self-defense devices is well known. More specifically, portable self-defense devices heretofore devised and utilized for the purpose of providing protection from assailants are known to consist basically of familiar, expected and obvious structural configurations. Notwithstanding the myriad of designs that have been developed for the fulfillment of countless objectives and requirements, many portable self-defense devices, including non-lethal methods for overcoming threatening and/or dangerous opponents, have several undesirable characteristics that limit their utility to law enforcement, military personnel, and others.

The objective of many portable self-defense devices is to distract or temporarily disable the opponent so that they may be captured, while minimizing casualties to those employing the methods. Tear gas, pepper spray, taser guns and rubber bullets are just a few examples. Other examples include rifle-mounted direct-energy weapons, e.g., green laser "dazzler" units, are used by the U.S. military at security checkpoints. Dazzlers, generally, are considered effective at a range of tens to hundreds of meters, but are not suitable for indoor, close-range use.

Similarly, sonic weapons such as the Long-Range Acoustic Device (LRAD), produced by Genasys Inc. of San Diego, Calif., have been employed to control crowds, disperse riots, and deter pirates. While the LRAD is gradually demonstrating its efficacy, the LRAD system is unsuitable for use indoors at close range Stun grenades or flash-bangs employ both a single blinding flash and a loud bang to temporarily disorient enemies in military and police actions. Exposed personnel experience disorientation, confusion, and loss of coordination and balance. While these systems have garnered widely-accepted efficacy, and their effects are intended to be temporary, the extreme intensity of their operation presents a significant risk of permanent injury or death. Consequently, stun grenades are generally classified as "less-lethal weapons," and their legal use in civilian contexts remains strictly limited.

Many existing portable self-defense devices, while not considered to be lethal weapons, can cause serious, if not lethal harm. As a result, the deployment of such non-lethal weapons represents an unacceptably accelerated escalation along the typical continuum of force that is utilized by a law enforcement agency. In some instances, the damages can be permanent and/or irreversible. Additionally, such weapons are not suitable in indoor applications and/or at close range. Thus, there is a need for an improved self-defense device.

SUMMARY

The following summary is provided to introduce a selection of concepts in a simplified form that are further described below in the detailed description. This summary is not intended to identify key features or essential features of the claimed subject matter, nor is it intended to be used to limit the scope of the claimed subject matter.

In various implementations, a non-lethal disorientation apparatus includes an elongated tubular body having a first tubular extension at one end and a second tubular extension at the opposite end. The first tubular extension has a high-intensity light source mounted therein and an opening with the light source being mounted to project a narrow, high intensity light beam through the opening. A cap has light transmitting material covering the opening. The elongated tubular body includes a power supply mounted therein, a switch mounted thereon, and circuitry connecting the switch to the power supply and the power supply to the light source. The switch can be actuated to activate the power supply to supply power to the light source.

In other implementations, an illumination device includes an elongated tubular housing for holding a high-intensity light source, a switch, and a power supply connected to one another. The switch controls the flow of power from the power supply to the high intensity light source. The high intensity light source can be activated by the switch to produce a high intensity, narrow light beam that can be directed to the eyes of a person to disorient the person.

In yet other implementations, a method for assembling a non-lethal disorientation device includes connecting a high intensity light source to a power supply with circuitry and a switch to form a high intensity light assembly. The high intensity light assembly is inserted into an elongated tubular body having a first tubular extension at one end and a second tubular extension at the opposite end with the first tubular extension including an opening. The high intensity light assembly is mounted within the elongated tubular body, so that the high-intensity light source can project a narrow, high intensity light beam through the opening upon activation by the switch. The opening is covered with a cap having light transmitting material.

These and other features and advantages will be apparent from a reading of the following detailed description and a review of the appended drawings. It is to be understood that the foregoing summary, the following detailed description and the appended drawings are explanatory only and are not restrictive of various aspects as claimed.

DETAILED DESCRIPTION

The subject disclosure is directed to a non-lethal disorientation apparatus and, more specifically, to a non-lethal disorientation apparatus that includes a light source that can emit a high-intensity, narrow beam to blind threatening and/or disruptive individuals, temporarily, at close range. In some embodiments, the light source can emit strobing light produced by an LED or a laser. The apparatus can be used in law enforcement, by the military, or, even, by civilians for self-defense. The apparatus can be sold in an assembled form or in a kit.

The detailed description provided below in connection with the appended drawings is intended as a description of examples and is not intended to represent the only forms in which the present examples can be constructed or utilized. The description sets forth functions of the examples and sequences of steps for constructing and operating the examples. However, the same or equivalent functions and sequences can be accomplished by different examples.

References to "one embodiment," "an embodiment," "an example embodiment," "one implementation," "an implementation," "one example," "an example" and the like, indicate that the described embodiment, implementation or example can include a particular feature, structure or characteristic, but every embodiment, implementation or example can not necessarily include the particular feature, structure or characteristic. Moreover, such phrases are not necessarily referring to the same embodiment, implementation or example. Further, when a particular feature, structure or characteristic is described in connection with an embodiment, implementation or example, it is to be appreciated that such feature, structure or characteristic can be implemented in connection with other embodiments, implementations or examples whether or not explicitly described.

Numerous specific details are set forth in order to provide a thorough understanding of one or more embodiments of the described subject matter. It is to be appreciated, however, that such embodiments can be practiced without these specific details.

Various features of the subject disclosure are now described in more detail with reference to the drawings, wherein like numerals generally refer to like or corresponding elements throughout. The drawings and detailed description are not intended to limit the claimed subject matter to the particular form described. Rather, the intention is to cover all modifications, equivalents and alternatives falling within the spirit and scope of the claimed subject matter.

Figure 1:
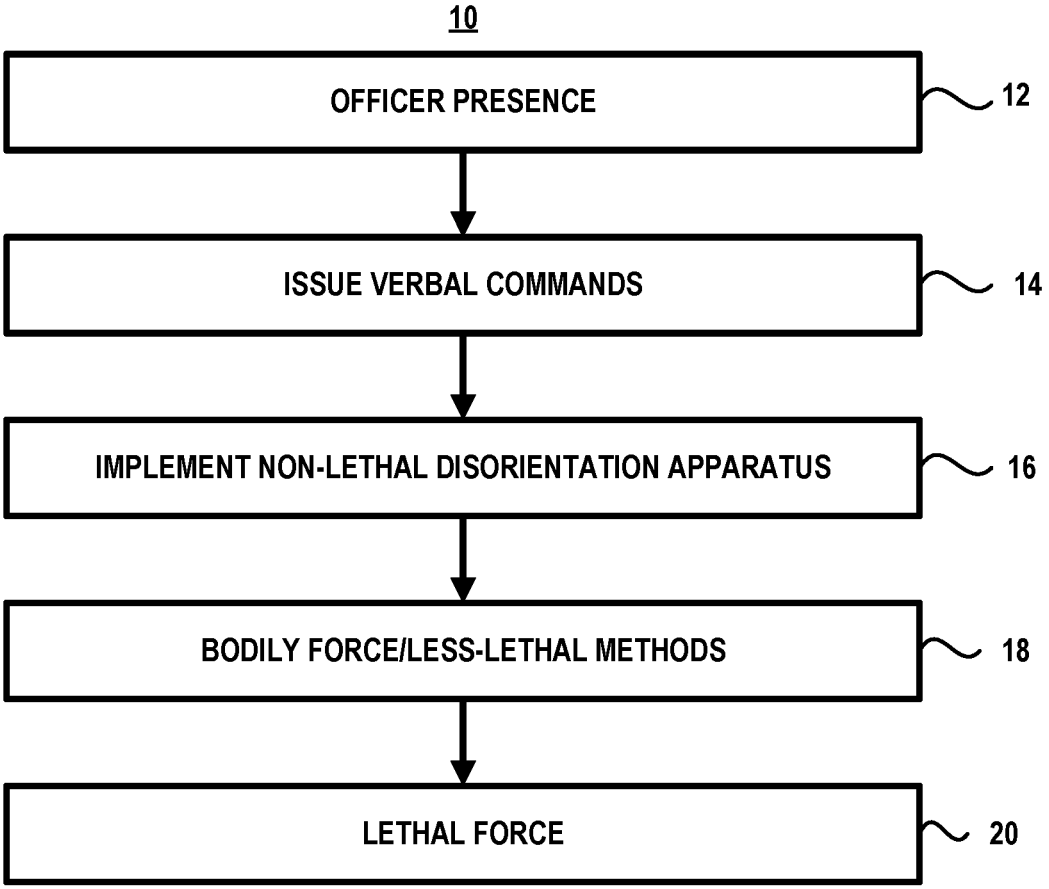
FIG. 1 is a block diagram illustrating an exemplary continuum of force that can be implemented using the subject of the present disclosure.
Figure 2:
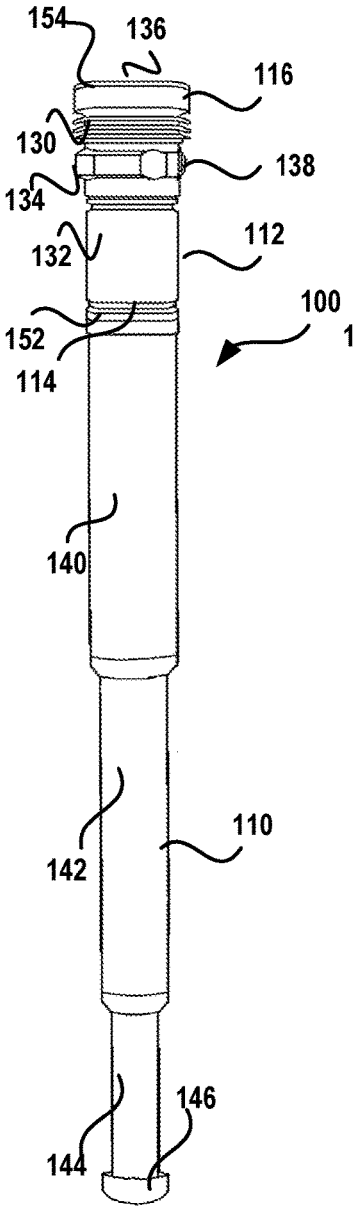
FIG. 2 is a perspective view of an embodiment of a non-lethal disorienting system that includes an expandable baton in an expanded configuration.
Figure 3:
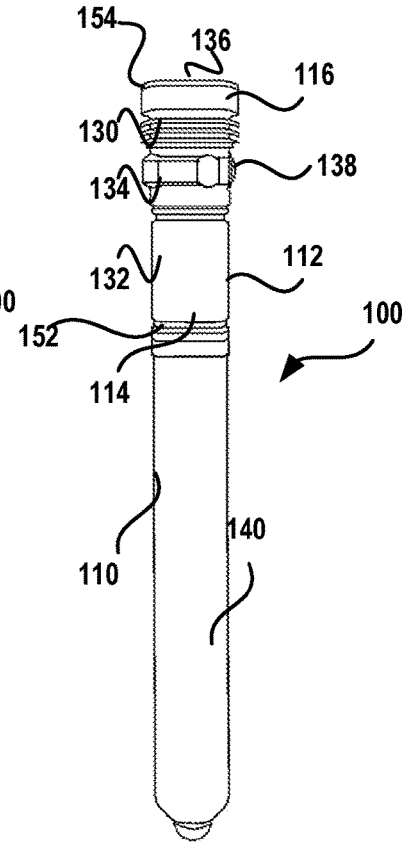
FIG. 3 is another perspective view of the embodiment of the non-lethal disorienting system shown in FIG. 2 that includes the expandable baton in a collapsed or retracted configuration.
Figure 4:
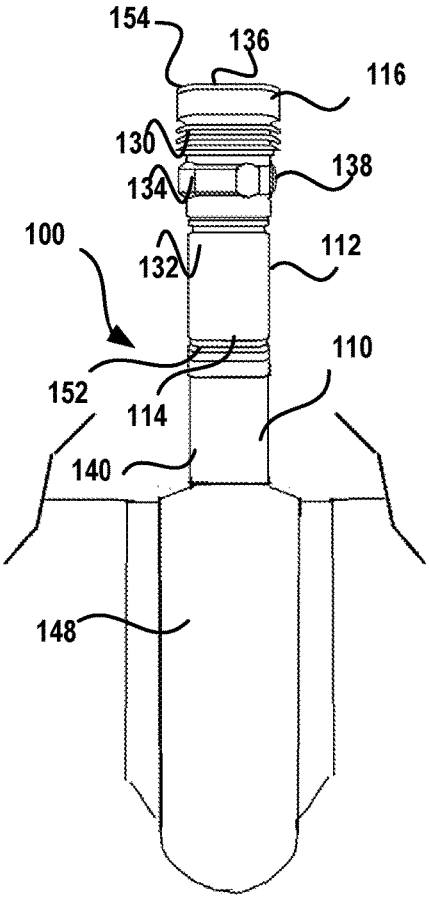
FIG. 4 is a fragmentary perspective view of the embodiment of the non-lethal disorienting system shown in FIGS. 2-3 positioned within a holster for a law enforcement officer.
Figure 5:
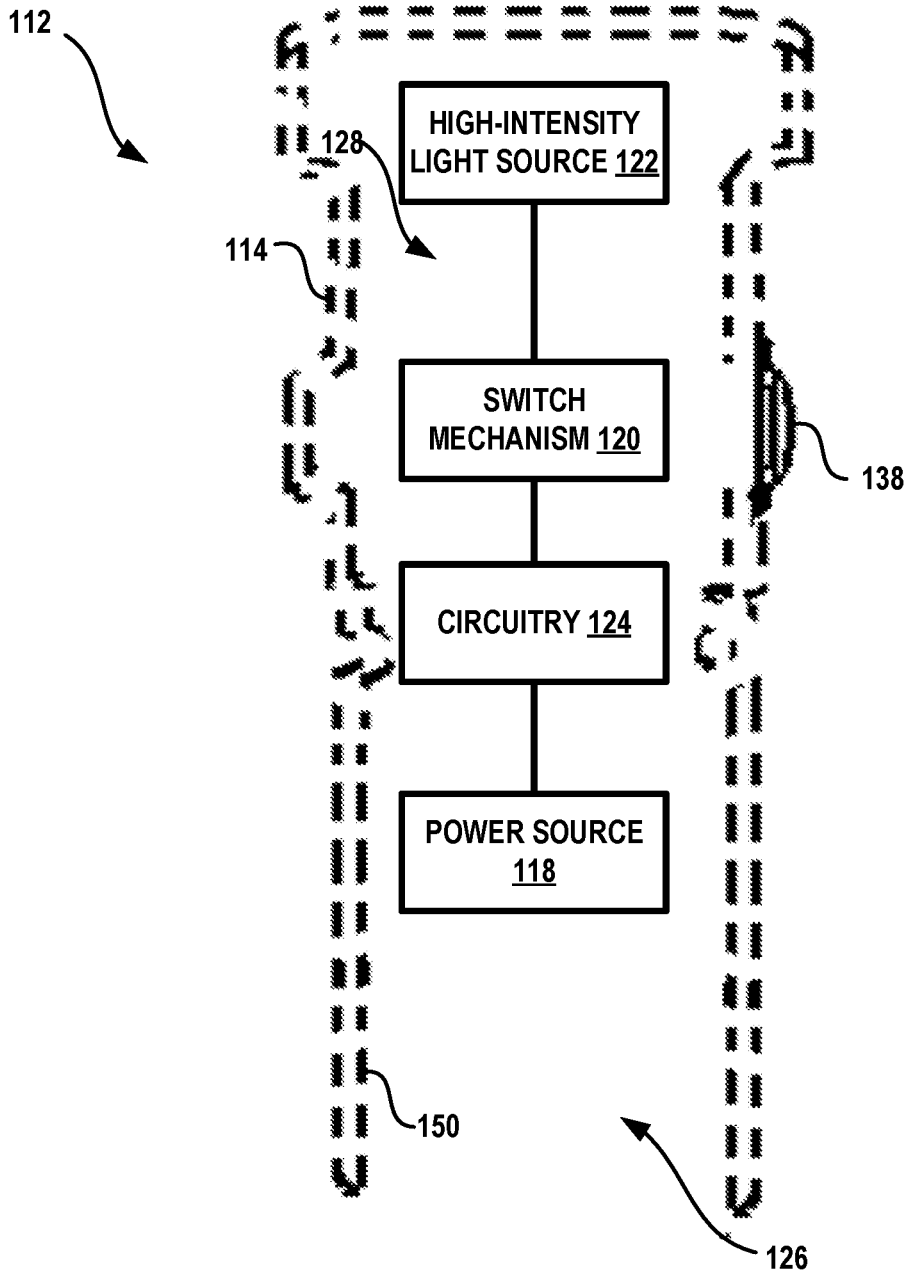
FIG. 5 is a schematic diagram of the embodiment of the non-lethal disorienting system shown in FIGS. 2-4.

Referring now to FIG. 1, there is shown an exemplary new continuum of force, generally designated by the numeral 10, that can be implemented by a law enforcement agency using the subject matter of this disclosure. The continuum 10 illustrates an escalating series of actions that law enforcement officers can take to resolve a disruptive or threatening incident. The continuum 10 includes a plurality of levels 12-20 that represent the level of force appropriate for a particular situation. It should be understood that law enforcement officers can move from one level to another within the continuum 10 in a matter of seconds during a particular incident.

At Level 12, one or more law enforcement officers are present. As long as the incident remains at this level, no force is necessary. If the incident can be resolved at Level 12, the mere presence of law enforcement officers deters crime. In most instances, the law enforcement officers act in a professional and non-threatening manner.

At Level 14, law enforcement officers issue verbal commands to try to resolve the incident. In most instances, the verbal commands will be issued in a calm, non-threatening manner. The commands can include requests to produce identification, permits, etc. If the incident is unresolved, the law enforcement officers can increase their volume and shorten commands to try to gain compliance.

At Level 16, one or more non-lethal disorientation apparatuses that are the subject of this disclosure is deployed. The non-lethal disorientation apparatuses include light sources that can emit high-intensity, narrow beams to disorient, temporarily, threatening and/or disruptive individuals. The non-lethal disorientation apparatus can incapacitate individuals at close range without causing permanent damage.

At Level 18, law enforcement officers can utilize bodily force and/or less-lethal weapons to resolve the incident. The less-lethal weapons can include blunt impact weapons, such as a baton or a projectile, to immobilize a combative individual. Alternatively, law enforcement officers can utilize use chemical devices, such as devices that emit chemical sprays or projectiles embedded with chemicals to restrain an individual (e.g., pepper spray), or electrical devices, such as Conducted Energy Devices (CEDs) that discharge a high-voltage, low-amperage jolt of electricity at a distance.

At Level 20, law enforcement officers can use lethal weapons to gain control of the incident. Lethal force is limited to incidents in which disruptive individuals pose a serious threat to the law enforcement officers or to other individuals. The lethal force can be delivered through firearms.

Referring now to FIGS. 2-5 with continuing reference to the foregoing figures, a non-lethal disorienting system, generally designated by the numeral 100, is shown. The system 100 includes an expandable baton 110 and a non-lethal disorienting apparatus 112 that is releasably attached to the expandable baton 110. The non-lethal disorienting apparatus 112 can be used at Level 16 in the continuum 10 shown in FIG. 1 to project a high-intensity, narrow beam of light to disorient a disruptive individual during an incident. The expandable baton 110 can be used at Level 18 to apply non-lethal force.

The apparatus 112 includes an elongated tubular body 114, a cap 116, a power supply 118, a switch mechanism 120, a light source 122, and circuitry 124. The elongated tubular body 114 can form a housing with an internal bore 126 extending therethrough. The cap 116, the power supply 118, the switch mechanism 120, the light source 122, and the circuitry 124 can connect to one another to form an assembly 128 that inserts into the internal bore 126.

The elongated tubular body 114 is essentially cylindrical with a pair of tubular extensions 130-132 connected to a center portion 134. The tubular extension 130 is positioned at one end of the center portion 134. The tubular extension 132 is positioned at the opposite end. The light source 122 is a high-intensity light source that is mounted within the tubular extension 130.

The tubular extension 130 has an opening 136 at one end. The light source 122 is adjacent to the opening 136 and is positioned to project a concentrated narrow, high intensity light beam through the opening 136. The cap 116 covers the opening 136 and includes light transmitting material to allow the concentrated narrow, high intensity light beam to project therethrough.

The light source 122 produces a narrow, highly defined beam that can have an intensity that exceeds 10,000 candelas, typically ranging from 10,000 candelas to 14,000 candelas. In some embodiments, the light beam typically has an intensity of 11,000 candelas. The light beam is well defined in that the edges of the beam do not bleed out, so that the light beam can be focused on a target. The use of a highly defined, intense beam is particularly important for focusing the beam on a single bad actor within a crowd.

The light source 122 is connected to the power supply 118 with the switch mechanism 120 and the circuitry 124. The power supply 118 supplies power to light source 122 with the switch mechanism 120 controlling the flow of power from the power supply 118 to the light source 122. The switch mechanism 120 includes a push-button 138 that can be actuated to activate the light source 122.

In some embodiments, the light source 122 will deactivate or turn off within 20 seconds after activation by the switch mechanism 120. In other embodiments, the switch must be actuated to deactivate the power supply 118 to prevent the flow of power to the light source 122. The power supply 118 can be a battery, such as a 3 Volt coin battery assembly.

As shown in FIGS. 2-5, the expandable baton 110 can include three telescoping members 140-144 and a tip 146. The baton 110 is movable from an expanded configuration, shown in FIG. 2, to a retracted or collapsed configuration, shown in FIG. 3. When the baton 110 is in the collapsed configuration, the baton 110 can be stored in holster 148 with the non-lethal disorienting apparatus 112 extending outwardly from the holster 148 to facilitate gripping by a user. The expandable baton 110 can be the type of baton that is sold under the brand name Friction Loc Baton or Talon by ASP, Inc. of Appleton, Wis.

The configuration of the baton 110 within the holster 148 provides the user with access to the push-button 138 when the non-lethal disorientation system 100 is removed therefrom. The position of the push-button 138 in relation to the holster 148 provides the user with the ability to depress the push-button 138 by his or her pinky to activate or to deactivate the light source 122, as needed. In some embodiments, the push-button 138 can be configured to return to its original position upon release.

The expandable baton 110 can be releasably attached to the non-lethal disorienting apparatus 112 through a threaded connection between the tubular extension 132 and the tubular member 140. The tubular extension 132 can form a flange at the end with an interior mating surface 150. The tubular member 140 can have a corresponding exterior mating surface 152. In this exemplary embodiment, the interior mating surface 150 and the exterior mating surface 152 include complementary threads to facilitate connection of the expandable baton 110 to the non-lethal disorienting apparatus 112.

The light source 122 can be white light source that produces a high-intensity white light or a laser. The light source 122 can emit a light beam in a strobe pattern that can be predetermined. The circuitry 124 can control the strobe pattern through a program that can be preprogrammed and hardwired therein. Alternatively, the circuitry 124 can be programmable. In some embodiments, the light source 124 includes a Light Emitting Diode (LED) and a chip for controlling the LED. The chip can allow the LED to produce the high-intensity, narrow beam of light for a predetermined period of times, such as 20 seconds, before turning off the light beam to allow the light source 124 to cool.

As shown in FIGS. 2-5, the cap 116 can include a lens 154 for covering the opening 136. The lens 154 is formed from the light transmitting material. The light transmitting material can be a plastic material, a ceramic material, or a composite material that is transparent, semi-transparent, or translucent. In some embodiments, the light transmitting material can be polycarbonate and, in particular, a polycarbonate that has a high transparency and a high resistance to ultraviolet ray damage or degradation.

In some embodiments, the lens 154 provides a light beam of uniform intensity. The lens 154 can be a 10048 Spot Lens from Carclo Technical Plastics of Latrobe, Pa. In such embodiments, the lens 154 can produce a light beam that has a 3 inch diameter with a 1:1 uniformity at six feet. In other embodiments, the lens 154 can be modified to produce a light beam that has 4.2 inch diameter with a 1:1 uniformity at eight feet.

The apparatus 112 and, in particular, the elongated tubular body 114 can be made from any suitable material through any suitable manufacturing method. Suitable materials include flexible, rigid, or semi-rigid materials. Suitable materials also include metals, ceramics, plastics, and composites. It should be understood that each component of the apparatus 112 can be made of a material that is specifically suited for the individual structural tolerances. Any combination of material or a uniform application of a single material that results in an acceptably robust structure is suitable.

Figure 6:
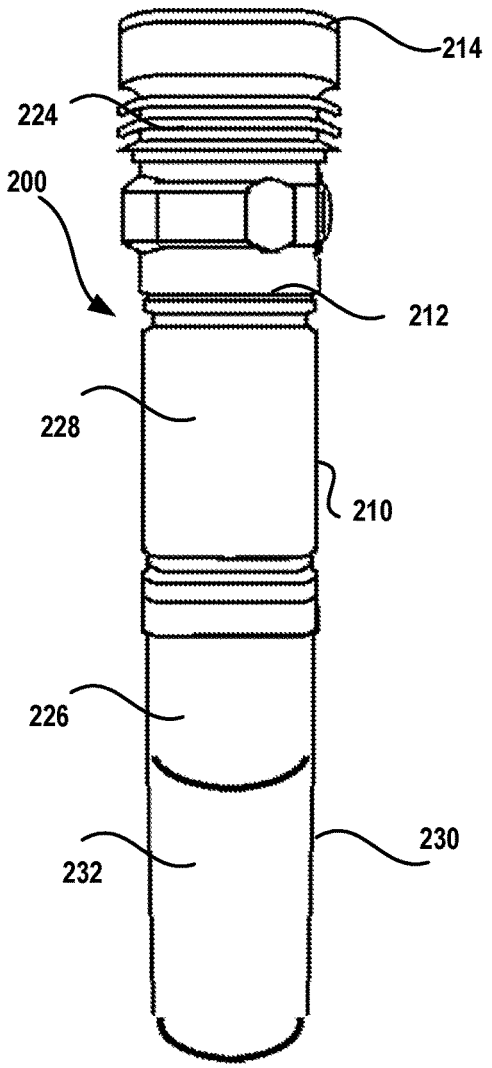
FIG. 6 is a perspective view of another embodiment of a non-lethal disorienting system.
Figure 7:
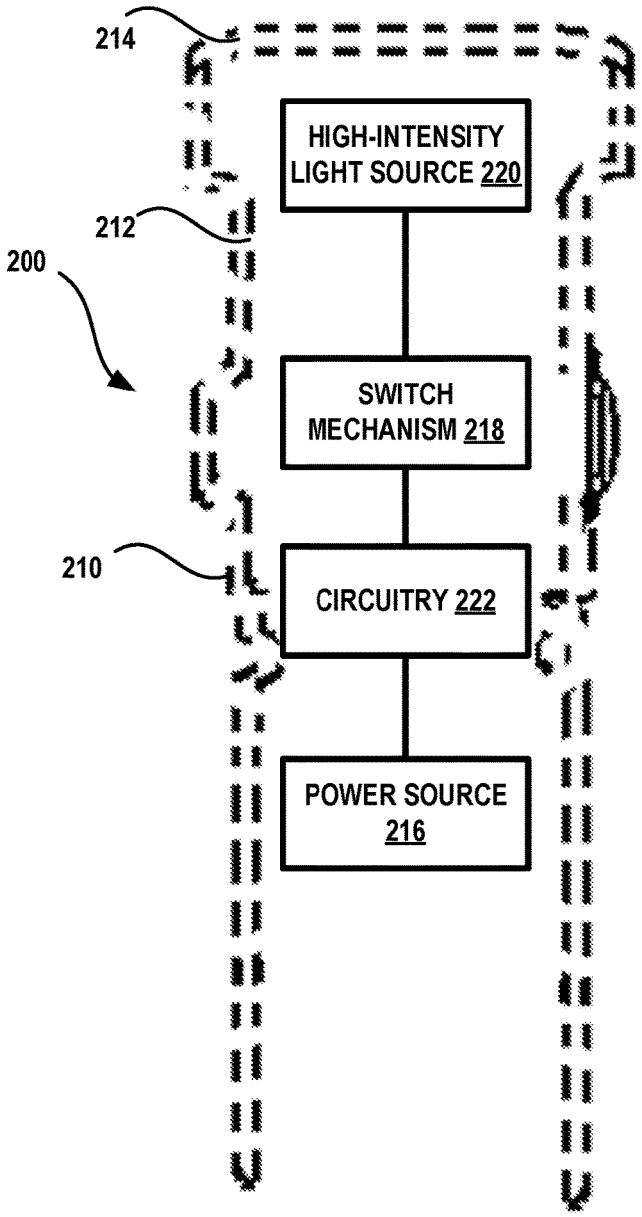
FIG. 7 is a schematic diagram of the embodiment of the non-lethal disorienting system shown in FIG. 6.

Referring now to FIGS. 6-7 with continuing reference to the foregoing figures, there is shown another embodiment of a non-lethal disorienting system, generally designated by the numeral 200. The system 200 is a stand-alone system that includes a non-lethal disorienting apparatus 210 that includes an elongated tubular body 212, a cap 214, a power supply 216, a switch mechanism 218, a light source 220, and circuitry 222.

The cap 214, the switch mechanism 218, and the circuitry 222 function in a similar manner as the cap 116, the switch mechanism 120, and the circuitry 124 shown in FIGS. 2-5. Unlike the embodiment shown in FIGS. 2-5, the power supply 216 and the light source 220 can produce a high-intensity, narrow beam that is of a lower intensity than the beam that is produced by the power supply 118 and the light source 122 shown in FIGS. 2-5. As a result, the non-lethal disorienting system 200 is suitable for civilian use.

Similarly, the elongated tubular body 212 is modular and includes a pair of tubular extensions 224-226 and a center portion 228. The tubular extension 224 and the center portion 228 are similar to the tubular extension 130 and the center portion 134 shown in FIGS. 2-5. Unlike the embodiment shown in FIGS. 2-5, the tubular extension 226 includes an outer surface 230 that forms a handle 232 for gripping.

Figure 8:
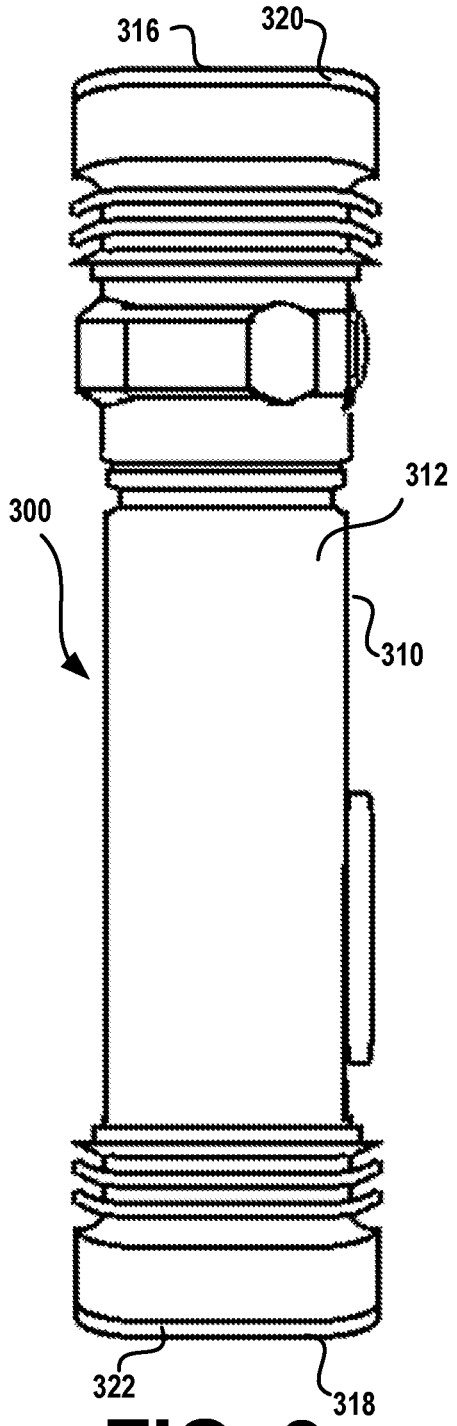
FIG. 8 is a perspective view of another embodiment of a non-lethal disorienting system.
Figure 9:
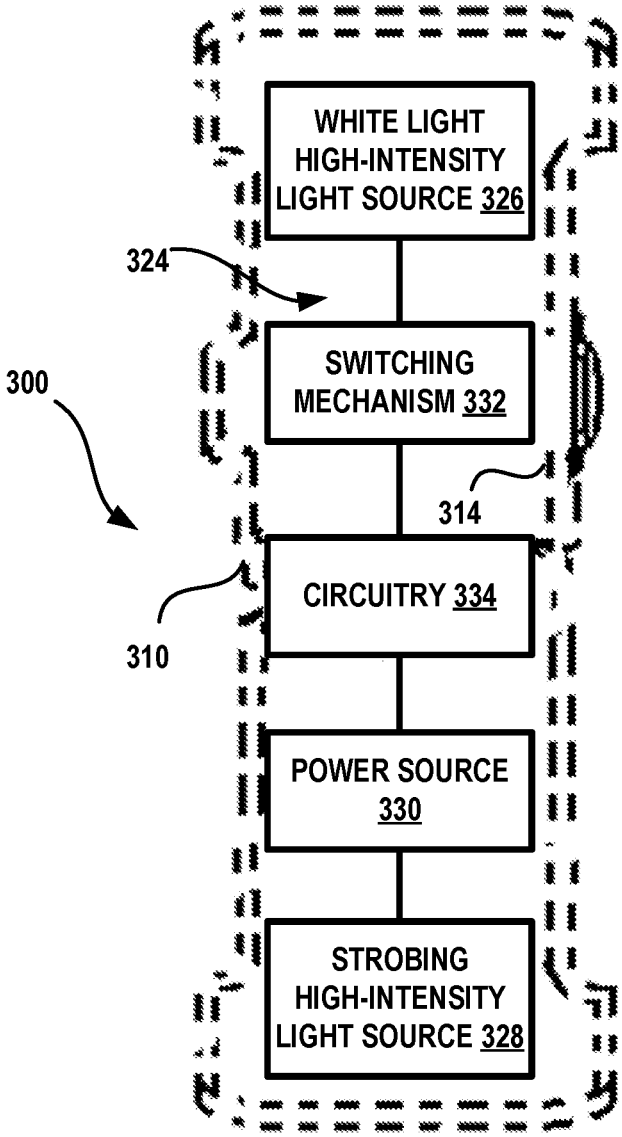
FIG. 9 is a schematic diagram of the embodiment of the non-lethal disorienting system shown in FIG. 8.

Referring now to FIGS. 8-9 with continuing reference to the foregoing figures, there is shown another embodiment of a non-lethal disorienting system, generally designated by the numeral 300. The system 300 includes a non-lethal disorienting apparatus 310 that is configured to project high-intensity, narrow beams in two different directions. In this exemplary embodiment, the apparatus 310 directs the beams in opposite directions.

The apparatus 310 includes an elongated tubular body 312 that includes an elongated bore 314 extending therethrough with openings 316-318 at the opposite ends. A pair of caps 320-322 cover the openings 316-318. The caps 320-322 include light transmitting materials to allow the beams to project outwardly therefrom.

The apparatus 310 includes a high intensity light assembly 324 that inserts into the elongated bore 314. The high intensity light assembly 324 includes a white light high-intensity light source 326 at one end and a strobing high intensity light source 328 at the opposite end. The white light high-intensity light source 326 projects a high intensity, narrow beam of white light through the opening 316. The strobing high intensity light source 328 projects a high intensity, narrow strobing beam of light through the opening 318.

The white light high-intensity light source 326 and the strobing high intensity light source 328 receive power from a common power supply 330. A switch mechanism 332 controls the supply of power to the white light high-intensity light source 326 and the strobing high intensity light source 328. The white light high-intensity light source 326 and the strobing high intensity light source 328 connect to the switch mechanism 332 with circuitry 334.

The white light high-intensity light source 326 and the strobing high intensity light source 328 can produce narrow beam can have intensities that exceed 10,000 candelas in military and in law enforcement applications. The white light high-intensity light source 326 and the strobing high intensity light source 328 can produce narrow beams that have lower intensities in civilian, self-defense applications.

Figure 10:
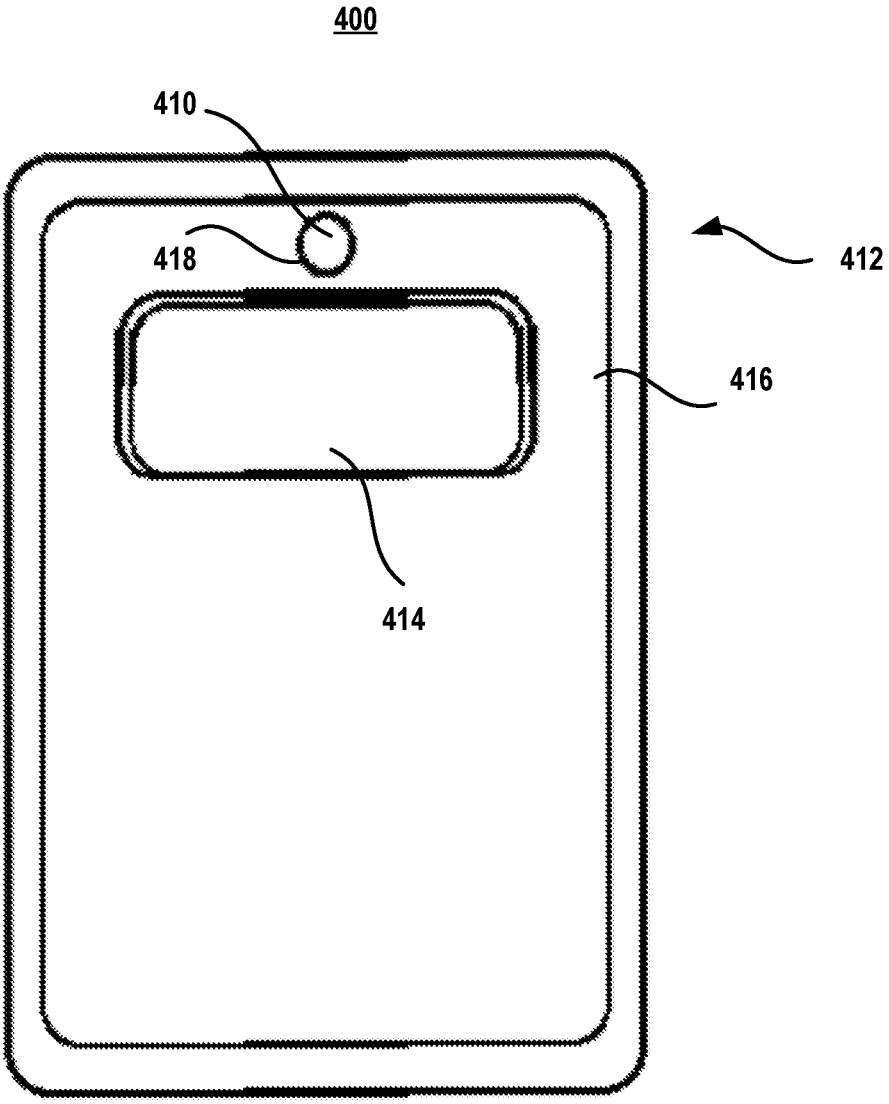
FIG. 10 is a perspective view of an embodiment of a non-lethal disorienting system that includes a riot shield.

Referring now to FIG. 10 with continuing reference to the foregoing figures, there is shown another embodiment of a non-lethal disorienting system, generally designated by the numeral 400, is shown. The system 400 includes a non-lethal disorienting apparatus 410 mounted on a riot shield 412. The non-lethal disorienting apparatus 410 is similar to the non-lethal disorienting apparatus 112 shown in FIGS. 2-5.

The riot shield 412 includes an arched body panel 414 with a window 416 therein. The window 416 includes a shatterproof light transmitting material. The convex side of the panel 414 has handles (not shown) at about the centerline of the panel 414 and spaced apart for convenient grasping of the riot shield 412.

The non-lethal disorienting apparatus 410 is mounted within a bore 418 that extends through arched body panel 414 to project a high intensity, narrow beam of light through the concave side of the body panel 414. It should be understood that the non-lethal disorienting apparatus 410 can be mounted in face shields and/or ballistic shields.

Figure 11:
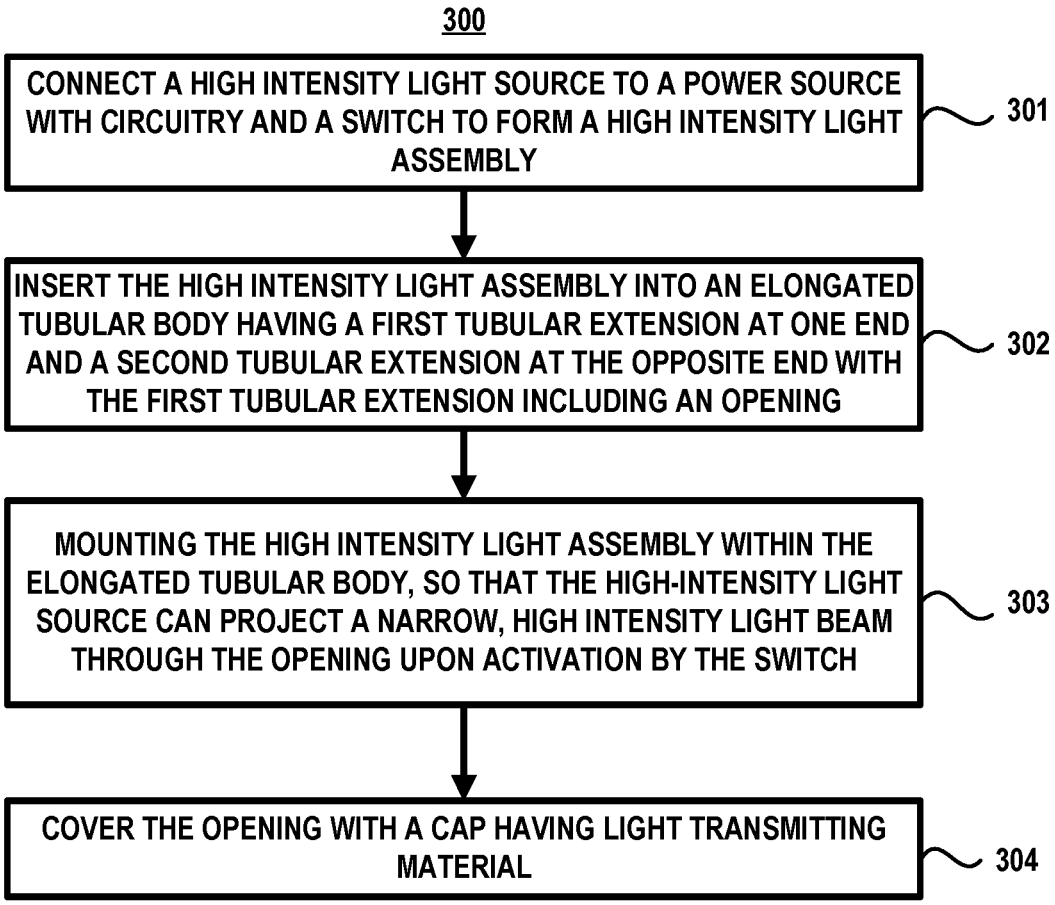
FIG. 11 is a process in accordance with the disclosure.

Referring to FIG. 11 with continuing reference to the foregoing figures, a method 500 for assembling a non-lethal disorienting device in accordance with the described subject matter is shown. Method 500, or portions thereof, can be performed to assemble the non-lethal disorienting apparatus 112 shown in FIGS. 2-5, the non-lethal disorienting apparatus 210 shown in FIGS. 6-7, the non-lethal disorientating apparatus 310 shown in FIGS. 8-9 and/or the non-lethal disorientating apparatus 410 shown in FIG. 10. The subject non-lethal disorienting device produced through method 500 can be utilized in a system that can be implemented at Level 16 in the continuum of force 10 shown in FIG. 1.

At 501, a high intensity light source is connected to a power supply with circuitry and a switch to form a high intensity light assembly. In this exemplary embodiment. In this exemplary embodiment, the light source can be the light source 122 shown in FIGS. 2-5, the light source 220 shown in FIGS. 6-7, and/or the white light high-intensity light source 326 and the strobing high intensity light source 328 shown in FIGS. 8-9.

The power supply can be the power supply 118 shown in FIGS. 2-5, the power supply 216 shown in FIGS. 6-7, and/or the power supply 330 shown in FIGS. 8-9. The switch can be the switch mechanism can be the switch mechanism 120 shown in FIGS. 2-5, the switch mechanism 218 shown in FIGS. 6-7, and/or the switch mechanism 332 shown in FIGS. 8-9.

At 502, the high intensity light assembly is inserted into an elongated tubular body having a first tubular extension at one end and a second tubular extension at the opposite end with the first tubular extension including an opening. In this exemplary embodiment, the elongated tubular body can be the elongated tubular body 114 shown in FIGS. 2-5, the elongated tubular body 212 shown in FIGS. 6-7, and/or the elongated tubular body 312 shown in FIGS. 8-9.

At 503, the high intensity light assembly is mounted within the elongated tubular body, so that the high-intensity light source can project a narrow, high intensity light beam through the opening upon activation by the switch.

At 504, the opening is covered with a cap having light transmitting material. In this exemplary embodiment, the cap can be the cap 116 shown in FIGS. 2-5, the cap 214 shown in FIGS. 6-7, the cap 320 and/or the cap 322 shown in FIGS. 8-9.

SUPPORTED FEATURES AND EMBODIMENTS

The detailed description provided above in connection with the appended drawings explicitly describes and supports various features of a non-lethal disorienting apparatus. By way of illustration and not limitation, supported embodiments include a non-lethal disorientation apparatus comprising: an elongated tubular body having a first tubular extension at one end and a second tubular extension at the opposite end, the first tubular extension having a high-intensity light source mounted therein and an opening with the light source being mounted to project a narrow, high intensity light beam through the opening, a cap having light transmitting material covering the opening, wherein the elongated tubular body includes a power supply mounted therein, a switch mounted thereon, and circuitry connecting the switch to the power supply and the power supply to the light source, and wherein the switch can be actuated to activate the power supply to supply power to the light source.

Supported embodiments include the foregoing non-lethal disorientation apparatus, wherein the switch can be actuated to deactivate the power supply to supply power to the light source.

Supported embodiments include any of the foregoing non-lethal disorientation apparatuses, wherein the switch is a push-button switch.

Supported embodiments include any of the foregoing non-lethal disorientation apparatuses, wherein the light source is selected from the group consisting of an LED light source and a laser.

Supported embodiments include any of the foregoing non-lethal disorientation apparatuses, wherein the light source can emit a predetermined strobe light pattern.

Supported embodiments include any of the foregoing non-lethal disorientation apparatuses, wherein the second tubular extension includes a flange.

Supported embodiments include any of the foregoing non-lethal disorientation apparatuses, wherein the second tubular extension flange forms a handle extending therefrom.

Supported embodiments include any of the foregoing non-lethal disorientation apparatuses, further comprising: a weapon selected from the group consisting of a baton and a shield, wherein the weapon includes a first mating surface the second extension includes a second mating surface and the first mating surface being configured to releasably connect to the second mating surface.

Supported embodiments include any of the foregoing non-lethal disorientation apparatuses, wherein the first mating surface and the second mating surface are threaded with complementary threads that releasably connect the first mating surface to the second mating surface.

Supported embodiments include any of the foregoing non-lethal disorientation apparatuses, wherein the shield is selected from the group selected from a face shield, a riot shield, and a ballistic shield.

Supported embodiments include any of the foregoing non-lethal disorientation apparatuses, wherein the baton is an expandable baton.

Supported embodiments include any of the foregoing non-lethal disorientation apparatuses, wherein the high-intensity light source is a first light source, the opening is a first opening, and the elongated body has a second opening, the non-lethal disorientation apparatus further comprising: a second light source directing light through the second opening.

Supported embodiments include any of the foregoing non-lethal disorientation apparatuses, wherein the second light source is mounted in the second tubular extension.

Supported embodiments include any of the foregoing non-lethal disorientation apparatuses, wherein the first light source and the second light source are mounted to direct light beams in opposite directions.

Supported embodiments include any of the foregoing non-lethal disorientation apparatuses, wherein the light source produces a high-intensity, narrow beam having an intensity of at least 10,000 candelas.

Supported embodiments include any of the foregoing non-lethal disorientation apparatuses, wherein the cap includes a lens for covering the opening and the lens is formed from the light transmitting material.

Supported embodiments include any of the foregoing non-lethal disorientation apparatuses, wherein the light transmitting material is a transparent plastic.

Supported embodiments include any of the foregoing non-lethal disorientation apparatuses, wherein the transparent plastic includes polycarbonate.

Supported embodiments include an illumination device comprising: an elongated tubular housing for holding a high-intensity light source, a switch, and a power supply connected to one another, wherein the switch controls the flow of power from the power supply to the high intensity light source, wherein the high intensity light source can be activated by the switch to produce a high intensity, narrow light beam that can be directed to the eyes of a person to disorient the person.

Supported embodiments include a method for assembling a non-lethal disorientation device, the method comprising: connecting a high intensity light source to a power supply with circuitry and a switch to form a high intensity light assembly, inserting the high intensity light assembly into an elongated tubular body having a first tubular extension at one end and a second tubular extension at the opposite end with the first tubular extension including an opening, mounting the high intensity light assembly within the elongated tubular body, so that the high-intensity light source can project a narrow, high intensity light beam through the opening upon activation by the switch, and covering the opening with a cap having light transmitting material.

Supported embodiments include another system, a method, an apparatus, and/or means for implementing any of the foregoing apparatuses or methods, or a portion thereof.

Supported embodiments can provide various attendant and/or technical advantages in terms of a non-lethal disorienting device that can temporarily disable an assailant using a high intensity narrow beam of light. The device can be configured to incapacitate the assailant without causing permanent damage.

Supported embodiments include a non-lethal disorienting device that can be implemented along a continuum of force prior to the use of bodily force or lethal force.

Supported embodiments include a non-lethal disorienting device that has applications in law enforcement, the military, and/or civilian self-defense.

Supported embodiments include a non-lethal disorientation device that can be optimized to produce a concentrated narrow beam of a predetermined intensity without requiring a power source that is too heavy or that produces too much heat for practical applications (i.e., hand-held use by security personnel and/or police officers).

The detailed description provided above in connection with the appended drawings is intended as a description of examples and is not intended to represent the only forms in which the present examples can be constructed or utilized.

It is to be understood that the configurations and/or approaches described herein are exemplary in nature, and that the described embodiments, implementations and/or examples are not to be considered in a limiting sense, because numerous variations are possible.

The specific processes or methods described herein can represent one or more of any number of processing strategies. As such, various operations illustrated and/or described can be performed in the sequence illustrated and/or described, in other sequences, in parallel, or omitted. Likewise, the order of the above-described processes can be changed.

Although the subject matter has been described in language specific to structural features and/or methodological acts, it is to be understood that the subject matter defined in the appended claims is not necessarily limited to the specific features or acts described above. Rather, the specific features and acts described above are presented as example forms of implementing the claims.

What is claimed is:

1. A non-lethal disorientation apparatus comprising:

a baton, an elongated tubular body having a first tubular extension at one end and a second tubular extension at the opposite end, the first tubular extension having a high-intensity light source mounted therein, a chip having circuitry thereon for controlling the light source, and an opening with the light source including a light emitting diode being mounted to project a narrow, high intensity light beam through the opening, the second tubular extension connecting to the baton, and a cap having light transmitting material covering the opening, wherein the elongated tubular body includes a power supply mounted therein, a switch mounted thereon, and circuitry connecting the switch to the power supply and the power supply to the light source, wherein the switch can be actuated to activate the power supply to supply power to the light source, and wherein the circuitry drives the light source to produce the high-intensity, narrow beam having an intensity between 10,000 and 14,000 candelas.

2. The non-lethal disorientation apparatus of claim 1, wherein the switch can be actuated to deactivate the power supply to turn off-power to the light source.

3. The non-lethal disorientation apparatus of claim 2, wherein the switch is a push-button switch.

4. The non-lethal disorientation apparatus of claim 1, wherein the light source can emit a predetermined strobe light pattern.

5. The non-lethal disorientation apparatus of claim 1, wherein the second tubular extension includes a flange.

6. The non-lethal disorientation apparatus of claim 5, wherein the second tubular extension flange forms a handle extending therefrom.

7. The non-lethal disorientation apparatus of claim 5, wherein the baton includes a first mating surface the second extension includes a second mating surface and the first mating surface being configured to releasably connect to the second mating surface.

8. The non-lethal disorientation apparatus of claim 5, wherein the first mating surface and the second mating surface are threaded with complementary threads that releasably connect the first mating surface to the second mating surface.

9. The non-lethal disorientation apparatus of claim 7, wherein the baton is an expandable baton formed from a plurality of members.

10. The non-lethal disorientation apparatus of claim 1, wherein the cap includes a lens for covering the opening and the lens is formed from the light transmitting material.

11. The non-lethal disorientation apparatus of claim 10, wherein the light transmitting material is a transparent plastic.

12. The non-lethal disorientation apparatus of claim 11, wherein the transparent plastic includes polycarbonate.

13. The non-lethal disorientation apparatus of claim 1, wherein the chip is configured to turn off the light source after a predetermined period of time.

14. The non-lethal disorientation apparatus of claim 13, wherein the predetermined period of time is about twenty seconds.

15. The non-lethal disorientation apparatus of claim 10, wherein the lens is configured to transform the high intensity, narrow light beam into a light beam of uniform intensity.

16. The non-lethal disorientation apparatus of claim 15, wherein the lens is configured to transform the high intensity, narrow light beam into a light beam of uniform intensity having a diameter of about 3 inches and a uniformity of about 1:1 about 6 feet.

17. The non-lethal disorientation apparatus of claim 15, wherein the lens is configured to transform the high intensity, narrow light beam into a light beam of uniform intensity having a diameter of about 4.2 inches and a uniformity of about 1:1 about 8 feet.

18. An illumination device comprising:

an elongated tubular housing having an opening therein and holding a high-intensity light source having a light emitting diode, a chip having circuitry thereon for controlling the light source, a switch, and a power supply connected to one another therein, and a baton connecting to the elongated tubular housing, wherein the switch controls the flow of power from the power supply to the high intensity light source, wherein the high intensity light source can be activated by the switch to produce a high intensity, narrow light beam that can be directed through the opening to the eyes of a living creature to disorient the living creature, and wherein the circuitry drives the light source to produce the high-intensity, narrow beam having an intensity between 10,000 and 14,000 candelas.

19. The non-lethal disorientation apparatus of claim 18, wherein the baton is an expandable baton formed from a plurality of members.

20. The non-lethal disorientation apparatus of claim 18, further comprising:

a cap having a lens for covering the opening, wherein the lens is formed from the light transmitting material.

* * * * *